United States Patent [19]

Vuille

[11] 4,259,735

[45] Mar. 31, 1981

[54] TIMEPIECE MOVEMENT WITH DIFFERENTIAL GEAR MECHANISM

[75] Inventor: Pierre-Alain Vuille, Grenchen, Switzerland

[73] Assignee: ETA A.G. Ebauches-Fabrik, Grenchen, Switzerland

[21] Appl. No.: 70,054

[22] Filed: Aug. 27, 1979

[30] Foreign Application Priority Data

Sep. 4, 1978 [CH] Switzerland ..... 9264/78

[51] Int. Cl.[3] ..... G04B 19/24

[52] U.S. Cl. ..... 368/34; 368/35; 368/185; 368/190; 368/197

[58] Field of Search ..... 58/85.5, 59, 58; 368/35, 185, 190, 197

[56] References Cited

U.S. PATENT DOCUMENTS 3,633,354 1/1972 Stemmler ..... 58/85.5 X 3,747,329 7/1973 Golay ..... 58/59

FOREIGN PATENT DOCUMENTS 1806686 6/1969 Fed. Rep. of Germany ..... 58/85.5

*Primary Examiner*—Ulysses Weldon

*Attorney, Agent, or Firm*—Stevens, Davis, Miller & Mosher

[57] ABSTRACT

In a timepiece movement, more particularly a quartz wrist watch movement, having a low-torque stepping motor, there is provided a differential mechanism which drives the hands and makes it possible to move the hour-hand alone in jumps. A cannon-pinion having a toothing acts as a sun gear. A planet gear is mounted on an hour-wheel which acts as a planet carrier. A ring gear takes the form of an annulus having internal teeth which is normally stationary but is controlled by a stem and can be rotated by jumps to cause the planet gear to roll along the cannon-pinion toothing, thus causing the planet carrier and consequently the hour hand to jump.

6 Claims, 5 Drawing Figures

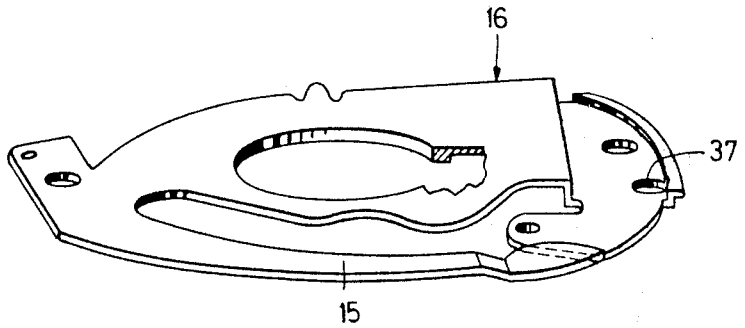
FIG. 2
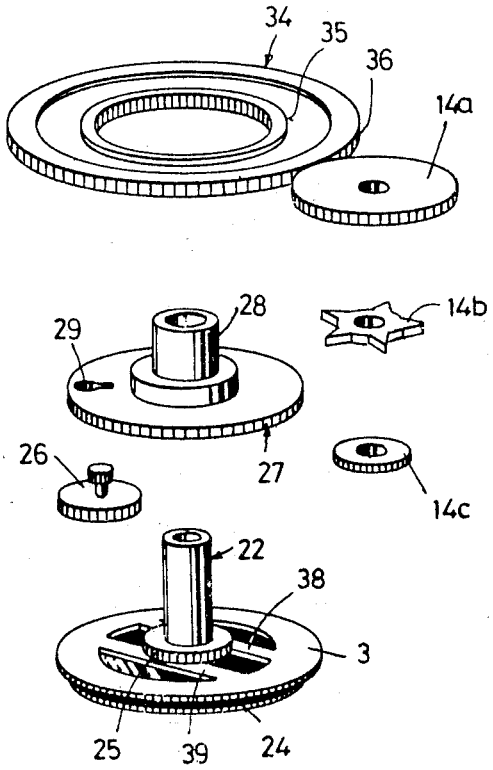

TIMEPIECE MOVEMENT WITH DIFFERENTIAL GEAR MECHANISM

This invention relates to a timepiece movement of the type having hands and comprising a differential gear mechanism controlling the position of an hour-hand and means for controlling this mechanism, the mechanism in turn comprising a planetary carrier, one or more planetary gears each having two coaxial sets of teeth, a sun gear, and a ring gear, the planet gear or gears simultaneously engaging the ring gear and the sun gear.

As a result of the commerical impetus given in recent years to the production of watch movements equipped with a mechanism for moving the hour-hand by jumps of one hour, numerous attempts have been made to design control mechanisms which satisfy the practical requirements under the best possible conditions.

Thus, U.S. Pat. No. 3,611,703 proposes a composite hour-wheel formed of two friction-coupled parts, the relative positions of these two parts being determined by inserting a pin, integral with one of the parts, in holes in the other part. It has been found, however, that this and other similar arrangements give rise to extremely serious regulating difficulties, above all when applied to electronic watches, where the torque is extremely low. As a matter of fact, in the arrangement as a whole there is friction between the cannon-pinion and the arbor which drives it, and additional friction in the composite hour-wheel. Whenever the position of the hour-hand is changed by acting upon one of the parts of the hour-wheel via the control mechanism, care must be taken to prevent the reaction exerted on the other part, engaging the gear train, from interfering with the operation of the motor. Moreover, the transmission of torque between the two parts of the composite wheel must be sufficient, for example, to actuate a calendar mechanism. The remaining limits within which adjustment is possible are often very narrow, and it is consequently difficult to guarantee the functioning of this coupling.

French Pat. No. 1,589,638 and Swiss Pat. No. 494,997 propose another solution in which the composite hour-wheel is replaced by a differential gear comprising a planetary carrier and a planet gear having two sets of teeth engaging the cannon-pinion and the hour-wheel, respectively. The planet gear normally acts as the minute-wheel; but by displacing the planetary carrier by means of a control member, the hour-wheel can be caused to rotate rapidly without changing the position of the cannon-pinion. A device of this type therefore obviates the presence of a friction coupling. German Disclosed Application (DOS) No. 1,673,621 also describes an arrangement of this kind.

German Disclosed Application (DOS) No. 2,730,948 likewise discloses a differential gear mechanism comprising a planet gear having two sets of teeth. In this case, it is the sun gear which constitutes the control part. The planet gear is mounted on a toothed disk constituting the center-wheel, and its pinion toothing engages the hour-wheel.

An analysis of the torques and of the forces exerted upon the various gears of these prior art mechanisms shows that they do not offer optimum operating conditions, so that it is difficult to adjust the amount of friction, for example. In another previously disclosed design (U.K. Pat. No. 1,226,453), there is no friction coupling at all. The gearing as a whole comprises numerous points of engagement, so that it is possible to act via a planetary gear upon an hour-hand indicating the local time in order to change its position without affecting the movement of the other hands. However, this arrangement is very complicated.

It is an object of this invention to provide a timepiece movement of the type initially mentioned in which the differential mechanism is arranged in such a way that the reaction exerted upon the gear engaging the wheel train when the hour-hand is re-set is kept to a minimum, so that it is therefore possible to utilize this mechanism in the movements of electronic quartz wrist watches in which the torque is very low, it being a known fact that for electronic watches, it is desirable to produce motors supplying the lowest possible torque in order to prolong battery life.

To this end, in the timepiece movement according to the present invention, the planetary carrier is designed as an hour-wheel, the sun gear is designed as a cannon-pinion, and the ring gear is an annulus having internal teeth encircling the path of the planet gear or gears and connected to the means for controlling the mechanism.

A preferred embodiment of the invention will now be described in detail with reference to the accompanying drawings, in which:

FIG. 2 is an exploded perspective view of the differential mechanism and of the retaining plate.

Figure 1:
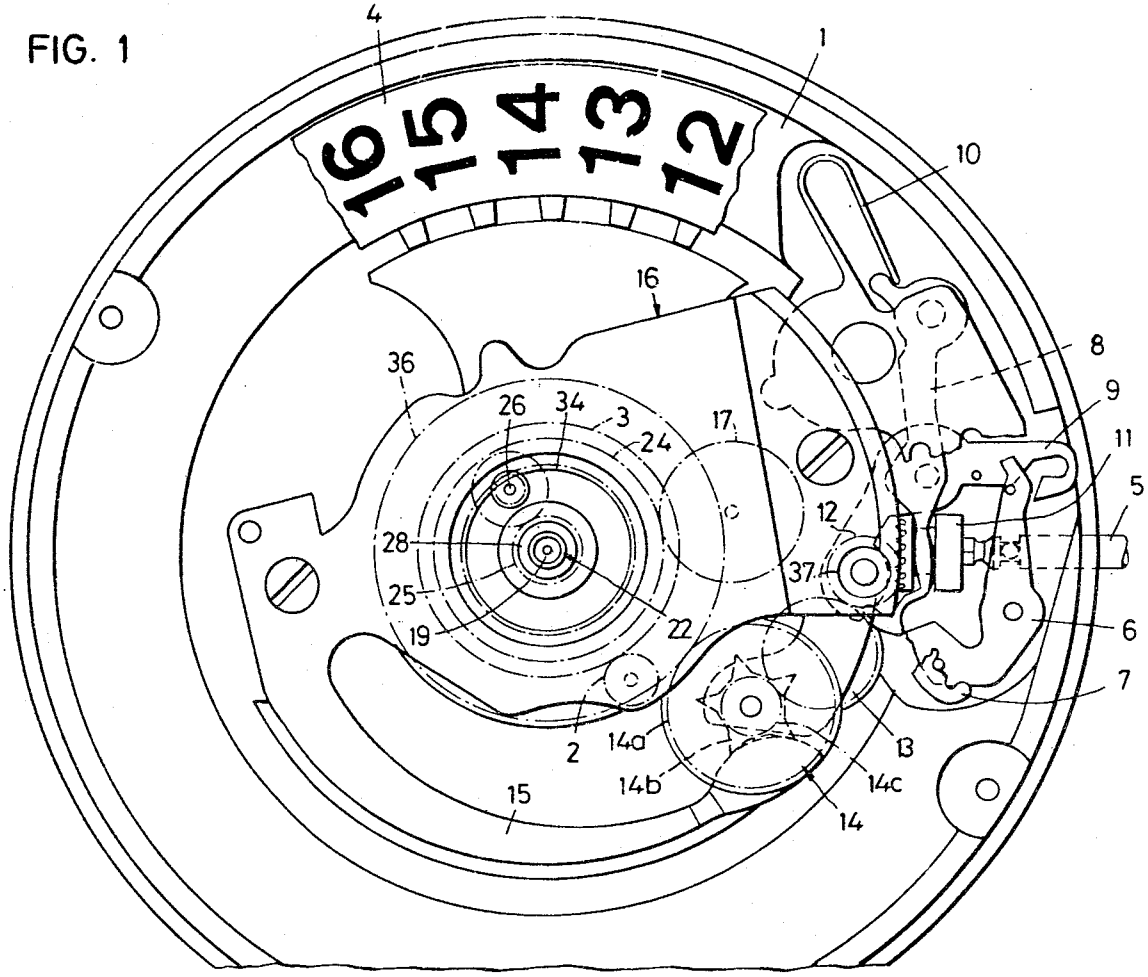
FIG. 1 is a top plan view in which certain parts are partially broken away.

The movement illustrated in FIG. 1 is that of a watch which may be either a battery-powered electronic quartz watch, having a stepping motor driving a wheel train, or a mechanical watch. All of the aforementioned elements are conventional; they are mounted on the reverse side of a plate 1 and are not shown in the drawing.

The wheel train includes a driving pinion 2 engaging a center-wheel 3 coaxial with the movement in such a way that wheel 3 is driven at the rate of one revolution per hour. Center-wheel 3 forms part of the assembly shown in FIGS. 2 and 3 and will be described below. The assembly illustrated in FIGS. 2 and 3 comprises in particular an hour-wheel which drives a calendar mechanism causing a date-ring 4 to advance by jumps, once every 24 hours. The calendar mechanism is likewise of a conventional type, so that it need not be described in detail here. As will be seen below, correction of the calendar is carried out by means of a control mechanism actuated by a stem 5 (FIG. 1). Stem 5 is disposed radially in the movement between plate 1 and the bridges. It actuates the control mechanism visible in FIG. 1, comprising a setting-lever 6 cooperating with a setting-lever spring 7, in the end of which there are three notches determining the three positions of stem 5 and of the mechanism. Setting-lever 6 cooperates with a clutch-wheel yoke 8 and with a setting-wheel yoke 9. The first of these yokes, biased by a spring 10, moves a clutch wheel 11 which is mounted on a square of stem 5, whereas yoke 9 bears a movable setting-wheel 12 engaging the rim toothing of clutch-wheel 11 in the outer and intermediate positions of stem 5, but which is disengaged from clutch-wheel 11 in the inner or neutral position. In the intermediate position of stem 5, shown in FIG. 1, setting-wheel 12 is engaged with a fixed-axis intermediate setting-wheel 13 meshing with the pinion of a control gear 14 comprising a pinion 14*c*, a wheel 14*a*, and a star 14*b* (FIG. 2).

Star 14*b* cooperates with a resilient arm 15 acting as a jumper and extending from a retaining plate 16 set on plate 1. The functions of gear 14 and jumper spring 15 will be explained below in relation to the differential mechanism which drives the hands. In the setting position of stem 5, movable setting-wheel 12 mounted on yoke 9 engages a setting-wheel 17 which meshes with the cannon-pinion, as will be seen below. Thus, stem 5 makes it possible both to set the hands and to advance the hour-hand alone by jumps of one hour. This latter function likewise makes it possible to correct the calendar in case of need. In the innermost position, stem 5 is disconnected, and this is a neutral position.

Figure 3:
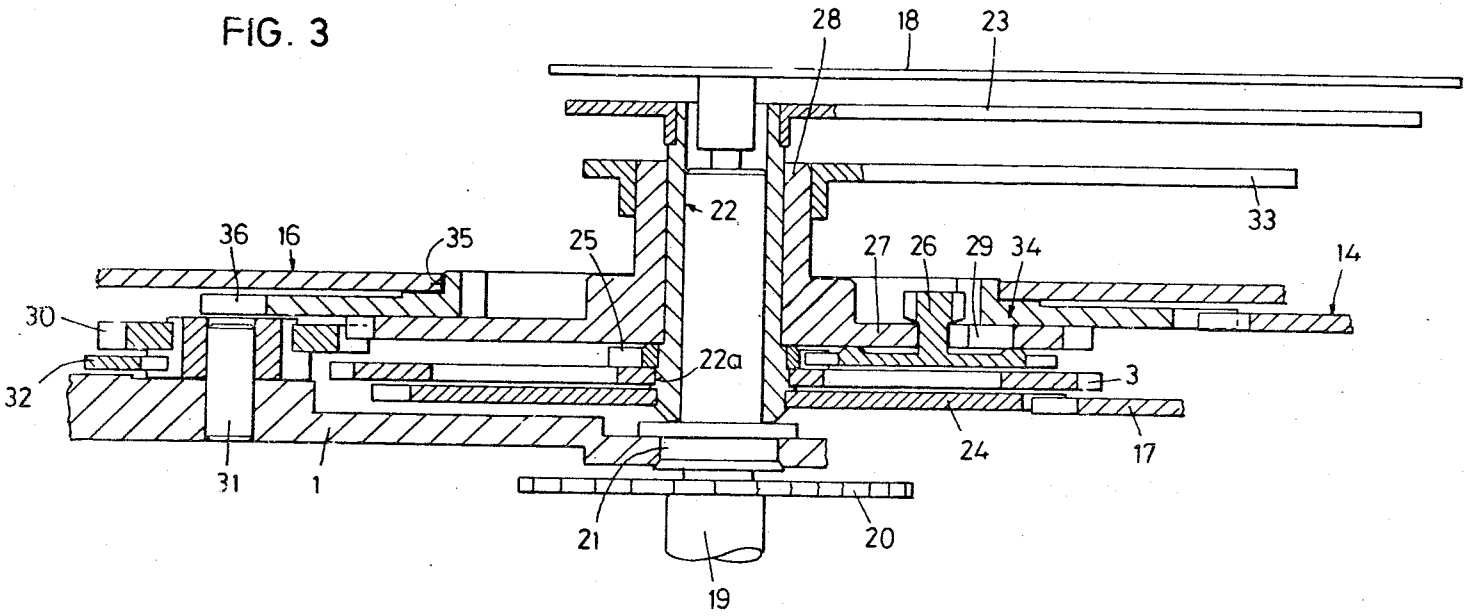
FIG. 3 is a sectional view, on a larger scale, showing the differential coupling and the hands.

FIGS. 2 and 3 shows how the motor and the control mechanism act upon the members which bear the hands. A seconds-hand 18 is mounted at the end of a fourth-wheel arbor 19 which includes a wheel 20 engaging the wheel train actuated by the motor. Arbor 19 is supported by a bearing 21 mounted in plate 1. The upper surface of bearing 21 holds in place the pipe of a cannon-pinion 22 bearing a minute-hand 23. Cannon-pinion 22 bears near the lower end thereof a large-diameter disk 24 provided with a peripheral toothing which meshes with setting-wheel 17. Above disk 24, cannon-pinion 22 includes a cylindrical bearing surface 22*a* on which center-wheel 3 is fitted. The snugness of this fitting is such that a friction coupling having a specific release torque is produced. In order to ensure a steady friction torque between center-wheel 3 and cannon-pinion 22, the disk of center-wheel 3 is blanked with two narrow, parallel bars 38 and 39, which may include arcuate indentations having a radius corresponding to that of bearing surface 22*a*. The grip exerted by bars 38 and 39 on the friction bearing surface of cannon-pinion 22 may thus be precisely regulated by allowing slight flexing of these bars.

As has been seen above, wheel 3 engages pinion 2 which transmits to cannon-pinion 22 the rotary motion emanating from the motor and consequently causes minute-hand 23 to rotate. A cannon-pinion toothing 25 is further driven onto the pipe of cannon-pinion 22, immediately above wheel 3. As may be seen in FIG. 3, toothing 25 meshes with the wheel teeth of a planet gear 26 having two sets of teeth, borne by a disk 27 integral with a pipe 28 and constituting, with this pipe, an hour-wheel. Disk 27 is provided with a keyhole-shaped hole 29 for attaching planet gear 26, which is machined in one piece with a pinion toothing of very small diameter and a wheel toothing which, as stated previously, meshes with cannon-pinion toothing 25.

The peripheral teeth of disk 27 mesh with the wheel toothing of a calendar gear 30 rotating on a pin 31 set in plate 1. The pinion toothing of calendar gear 30 drives a 24-hour wheel 32 provided with a resilient finger capable of driving calendar ring 4 once per revolution by engaging one of the internal teeth of the latter. Pipe 28, which bears an hour-hand 33, rests on the upper surface of cannon-pinion toothing 25 and is held in place by the last element of the differential mechanism. This last element, which acts as a ring gear, is an annulus 34 having internal teeth, a cylindrical pivoting surface 35 which is slightly larger in diameter than the internal toothing, and an external peripheral toothing 36. As may be seen from the drawing, annulus 34 is positioned by retaining plate 16, in the center of which is a round hole fitted to pivoting surface 35. Plate 16 covers the outer portion of annulus 34 and holds it in place axially. As plate 16 is screwed to plate 1, it holds the entire differential mechanism and control mechanism in place at the time of assembly, making it possible to fit all these elements into a very limited space.

Toothing 36 of annulus 34 engages the teeth of wheel 14*a* of gear 14 which, as has already been stated, further comprises star 14*b* situated immediately beneath wheel 14*a* and pinion 14*c* situated below star 14*b*. Intermediate setting-wheel 13 and gear 14 both pivot on pins set in plate 1 and are held in place axially by corresponding elements in retaining plate 16. Plate 16 further includes a hole 37 (FIGS. 1 and 2) for limiting the movements of movable setting-wheel 12 by cooperating with the end of the arbor of wheel 12, this arbor being integral with yoke 9 and projecting to the level of the portion of plate 16 which includes hole 37.

In normal operation, the hands are steadily driven by the motor of the watch. Whereas arbor 19, connected to the rotor of the motor by a gear train, is actuated by impulses, this gear train also transmits the torque to pinion 2 and wheel 3. The latter drives cannon-pinion 22 by friction; and since annulus 34 is stationary, toothing 25 of cannon-pinion 22 causes the pinion toothing of planet gear 26 to roll along the internal toothing of annulus 34. As a result, planetary carrier 27, which acts as the hour-wheel, rotates slowly about the axis of the movement, driven by the axle of planet gear 26. The ratios between the pinion and wheel toothings of planet gear 26, just as those of toothing 25 and of the internal toothing of annulus 34 and the radius of the axis of planet gear 26 will be so selected as to produce a reduction of 1 to 12 between the speed of rotation of cannon-pinion 22, which acts as the sun gear, and that of hour-wheel 27, which acts as the planet carrier, when annulus 34 is stationary.

When stem 5 is moved into the setting position, setting-wheel 12 engages setting-wheel 17, and rotation of stem 5 causes the rotation of disk 24 integral with cannon-pinion 22. In this condition, a contact will disconnect the motor of the watch, including the entire wheel train. Wheel 3 will be blocked, while cannon-pinion 22, friction-connected to wheel 3, will be driven at a relatively high speed. As during normal operation, but at a higher speed, toothing 25 will cause planet gear 26 to roll along the internal toothing of annulus 34, moving hour-hand 33 at a speed twelve times slower than that of minute-hand 23. Thus, hands 33 and 23 move in their normal ratio, seconds-hand 18 being stopped.

In the intermediate position of stem 5, the motor is not blocked, so that seconds-hand 18 advances at the rhythm imposed by the time-base of the watch. If stem 5 is rotated, intermediate setting-wheel 13 causes gear 14 to rotate, and the latter's rotation is marked by stopping positions in which the head of jumper 15 engages between two teeth of star 14*b*. Gear 14 therefore rotates in jerks. Since the angle of rotation, which for annulus 34 situated at the head of stem 5 corresponds to a 72° rotation of gear 14, is on the order of 60°, this angle is substantially that which is easily imparted to the crown by holding it between the thumb and index finger. As wheel 14*a* is engaging external toothing 36 of annulus 34, it is now the latter which is rotated. Hence the teeth of the wheel toothing of planet gear 26 press against toothing 25 of cannon-pinion 22, which acts as the sun gear, and planet gear 26 is caused to revolve about the axis of rotation of the hands by the internal toothing of annulus 34. Planet gear 26, by means of its axle, causes wheel 27 to rotate, driving hour-hand 33. The displacement corresponding to one jump of star 14*b* corresponds to 1/12 of a revolution of hour-hand 33 and, consequently, to an advance of one hour.

Figure 4:
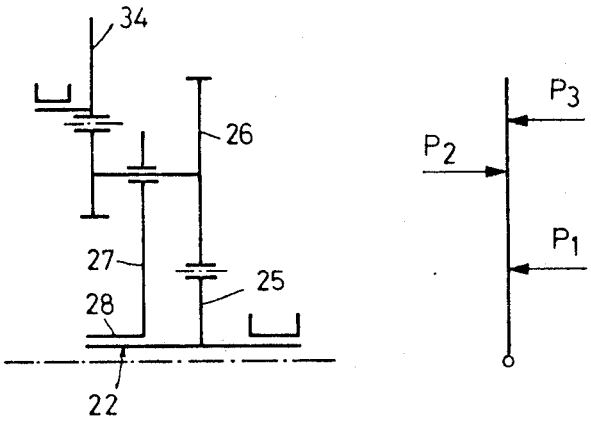
FIG. 4 is a diagram showing the distribution of forces at their several points of application.

FIG. 4 is a diagrammatic illustration of the whole differential mechanism described above, showing at the right-hand side the points of application of the forces. Ring gear 34 is force-driven by the control mechanism. It exerts upon the pinion toothing of planet gear 26 a force situated at level P3, hence a torque which is the product of the distance between that force and the axis of rotation of the hands multiplied by the tangential force. This torque causes hour-wheel 27 to be driven by pressing the wheel toothing of planet gear 26 against toothing 25 of cannon-pinion 22. The transmission of force to the planetary carrier (wheel 27) takes place at level P2, while the reaction on cannon-pinion 22 takes place at level P1. The tangential force exerted upon toothing 25 will be reduced in the ratio of the toothings of planet gear 26 relative to the tangential force exerted by ring gear 34 upon the pinion toothing of planet gear 26. This force will in turn be reduced in the ratio of the radius of the wheel toothing to the sum of the radii of the planet gear toothings relative to the force of tangential resistance offered by hour-wheel 27. Even at the time when this resistance is increased by tensing the spring of the calendar mechanism, the reaction on cannon-pinion 22 remains at a minimum.

Thus, by means of this arrangement of the differential assembly, an hour-hand control mechanism is obtained which offers maximum security as concerns the risk of reaction on the motor when the position of the hour-hand alone is changed.

Figure 5:
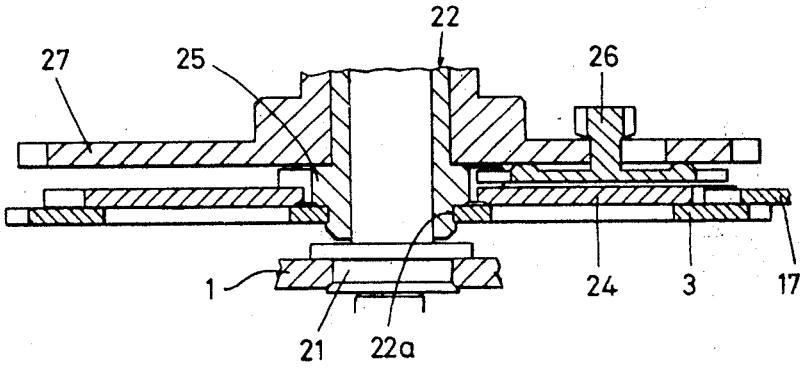
FIG. 5 is a partial section through a modification of the embodiment.

In the embodiment described above, the design of the center-wheel gearing, formed by cannon-pinion 22, its toothing 25, toothed wheel 24, and wheel 3, may be improved and simplified as shown in the partial view of FIG. 5. In this modification, toothing 25 is profile-turned in one piece with the pipe of cannon-pinion 22 and has teeth which are truncated at their base. Disk 24 is driven onto the truncated teeth of toothing 25, while cylindrical bearing surface 22*a* is situated below toothing 25, so that wheel 3 is below disk 24. This arrangement simplifies manufacture since it comprises only three parts rather than four. Moreover, the setting of wheel 3 on bearing surface 22*a* is easier to accomplish.

What is claimed is:

1. A timepiece movement having hands and comprising a differential gear mechanism controlling the position of an hour-hand and means for controlling said mechanism, said mechanism in turn comprising a planetary carrier, planet gear means having two coaxial sets of teeth, a sun gear, and a ring gear, said planet gear means engaging said ring gear and said sun gear, wherein said planetary carrier is designed as an hour-wheel, said sun gear is designed as a cannon-pinion having a toothing, and said ring gear is an annulus having internal teeth encircling the path of said planet gear means and connected to said means for controlling said mechanism.

2. The timepiece movement of claim 1, further comprising a time-indication control wheel, and said annulus further including external teeth meshing with said control wheel, whereby said annulus is either driven in jumps or blocked in any one of twelve predetermined positions about the axis of rotation of said hands.

3. The timepiece movement of claim 2, further comprising a jumper and a star cooperating with said jumper, said control wheel being directly connected to and movable with said star and pivoting about a fixed axis, and said star having a number of teeth such that a jump of one of said star teeth corresponds to an advance of 1/12 of a revolution of said hour-hand, said advance being brought about by the rolling of one of said sets of teeth of said planet gear means along said cannon-pinion toothing.

4. The timepiece movement of claim 1, further comprising a setting member and a large-diameter toothing engaging said setting member, said cannon-pinion being integral with said large-diameter toothing.

5. The timepiece movement of claim 1, further comprising a driven center-wheel mounted coaxially on said cannon-pinion and friction-coupled thereto.

6. The timepiece movement of claim 1, further comprising a calendar mechanism driven by said planetary carrier.

* * * * *